United States Patent [19]

Sato et al.

[11] Patent Number: 4,947,008

[45] Date of Patent: Aug. 7, 1990

[54] SWITCH DEVICE

[75] Inventors: Hiroyuki Sato; Yujiro Shimoyama, both of Furukawa, Japan

[73] Assignee: Alps Electric Co., Ltd., Tokyo, Japan

[21] Appl. No.: 170,920

[22] Filed: Mar. 17, 1988

[30] Foreign Application Priority Data

Jun. 1, 1987 [JP] Japan ..... 62-83186[U]

[51] Int. Cl.[5] ..... H01H 21/00

[52] U.S. Cl. ..... 200/6 R; 200/339

[58] Field of Search ..... 200/1 V, 6 R, 6 B, 6 BA, 200/6 BB, 431–439, 302.3, 315, 339

[56] References Cited

U.S. PATENT DOCUMENTS

| | | | |
|---|---|---|---|
| 2,927,983 | 8/1958 | Brown | 200/302.3 X |
| 4,314,111 | 2/1982 | Kobayashi | 200/339 X |
| 4,314,121 | 2/1982 | Gaber | 200/433 |
| 4,408,105 | 10/1983 | Tanaka | 200/437 |
| 4,780,580 | 10/1988 | Sawada | 200/1 V X |
| 4,803,317 | 2/1989 | Sutoh et al. | 200/6 BA X |

*Primary Examiner*—J. R. Scott

*Attorney, Agent, or Firm*—Guy W. Shoup; Gideon Gimlan

[57] ABSTRACT

A switch device where the components include an actuator bar and a spring which can be installed one after the other from above through an upper opening of a casing, thereby enabling automation of a switch assembly operation. The casing, having a fixed contact, eccentrically supports a rockable conductor plate with a movable contact at one end. A switch operating member having an actuator element and an operating element is pivotally mounted in the casing. The actuator element has a vertical through-hole into which the actuator bar and spring are placed. The actuator bar extends out of the bottom end of the actuator element to contact the conductor plate. The operating element has a depending pressing projection formed on its bottom matching the location of the top of the through-hole into which the actuator bar and spring are placed. As the operating element and the actuator element of the switch operating member are assembled, the depending pressing projection of the operating element compresses the spring to press the actuator bar against the conductor plate. When the switch operating member is pivoted about its axis the actuator bar causes the conductor plate to rock, thereby causing the fixed and movable contacts move together or separate to effect a switching action.

10 Claims, 4 Drawing Sheets

SWITCH DEVICE

BACKGROUND OF THE INVENTION

This invention relates to a switch device, and more particularly to a switch device of the seesaw type wherein a switch operating member is tilted to effect switching of the switch device.

Various types of switch devices have been used so far depending upon their applications. Switch devices which are conventionally used for operation of motors of antenna lifting devices or power window devices for cars are principally of the seesaw type. An exemplary one of such switch deveces of the seesaw type is shown in FIG. 4.

Referring to FIG. 4, the switch device shown includes a switch operating member 20 having a pressing member 22 mounted at the top thereof. As the pressing member 22 is suitably manually pressed, the switch operating member 20 is rocked in one of opposite directions indicated by a double-headed arrow mark X-Y around a fulcrum provided by a pair of support tabs 21. The switch operating member 20 has a blind hole 20*a* formed therein, and a compression coil spring 23 and an actuator bar 24 are received in the blind hole 20*a*. The actuator bar 24 is urged by the compression coil spring 23 into sliding contact with a conductor plate 25 located below the switch operating member 20. The conductor plate 25 is supported for rocking motion like a seesaw around a fulcrum provided by the top of a central terminal 26 and has a pair of movable contacts 27*a* and 27*b* mounted at opposite ends thereof. A pair of fixed contacts 30*a* and 30*b* are located for contact with the movable contacts 27*a* and 27*b*, respectively, and are connected to terminals 28 and 29, respectively. The terminals 26, 28 and 29 are mounted on a casing 31.

With the construction described above, if the pressing member 22 is depressed at one of opposite end portions thereof, the pressing member 22 and the switch operating member 20 integral therewith are rocked in one of the X and Y directions around the fulcrum provided by the support tabs 21. In the case of the arrangement shown in FIG. 4, the pressing member 22 and the integral switch operating member 20 are shown rocked in the X direction. In this case, the conductor plate 25 is rocked in the counterclockwise direction in FIG. 4 around the fulcrum at the top of the central terminal 26 until the movable contact 27*a* thereon is contacted with the fixed contact 30*a*. On the contrary, if the switch operating member 20 is rocked in the Y direction, similarly the movable contact 27*b* will be contacted with the fixed contact 30*b*.

By the way, in the switch device of the construction described above, the actuator bar 24 received together with the compression coil spring 23 in the bottomed blind hole 20*a* of the switch operating member 20 is held in resilient contact with an upper face of the conductor plate 25. Accordingly, in assembling the switch operating member 20 to the casing 31, it is necessary either to manually install the switch operating member 20 into the casing 31 from the side of an opening at the top of the casing 31 while paying attention so that the compression coil spring 23 and the actuator bar 24 do not drop out of the blind hole 20*a* of the switch operating member 20 or to install the switch operating member 20 into the casing 31 with the switch operating member 20 held upside down. This makes a significant factor which prevents automation of an assembling operation.

SUMMARY OF THE INVENTION

Accordingly, it is an object of the present invention to provide a switch device which eliminates the problem of the conventional arrangement described above and wherein components including an actuator bar and spring can be installed one afer another from the side of an upper opening of a casing, enabling automation of an assembling operation.

In order to attain the object, according to the present invention, there is provided a switch device which comprises a casing, a switch operating member including an actuator element and an operating element, a pin for mounting the switch operating member for pivotal motion at an upper portion of the casing, the actuator element having a through-hole formed therein, the actuator element further having a pin receiving hole formed therein in a direction perpendicular to the through-hole, the operating element having a depending pressing projection formed thereon which has a pin receiving hole formed therein and is inserted in the through-hole of the actuator element, the pin extending through the mutually aligned pin receiving holes of the actuator element and the operating element to unite the actuator element and the operating element with each other, a conductor plate mounted for rocking motion within the casing, an actuator bar received for sliding movement in the through-hole of the actuator element, and a spring received in the through-hole of the actuator element between an end of the pressing projection of the opeating element and an end of the actuator bar for urging the actuator bar to contact with the conductor plate, whereby a tilting motion of the switch operating member around the pin to slidably move the actuator bar on the conductor plate will cause rocking motion of the conductor plate to make a switching operation of the switch device.

With the construction described above, it is possible to form the switch operating member and support the switch operating member for pivotal motion on the casing by inserting the actuator bar, the spring and the pressing projection of the operating element one after another into the through-hole of the actuator element and then inserting the pin from a side into the mutually aligned pin receiving holes of those members. In this instance, the actuator bar and the spring can be installed from above the through-hole without putting the actuator element upside down, and the pin can be inserted with the upper end of the spring pressed down by the pressing projection. Accordingly, an assembling operation using an automated machine which has been considered difficult so far is enabled.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
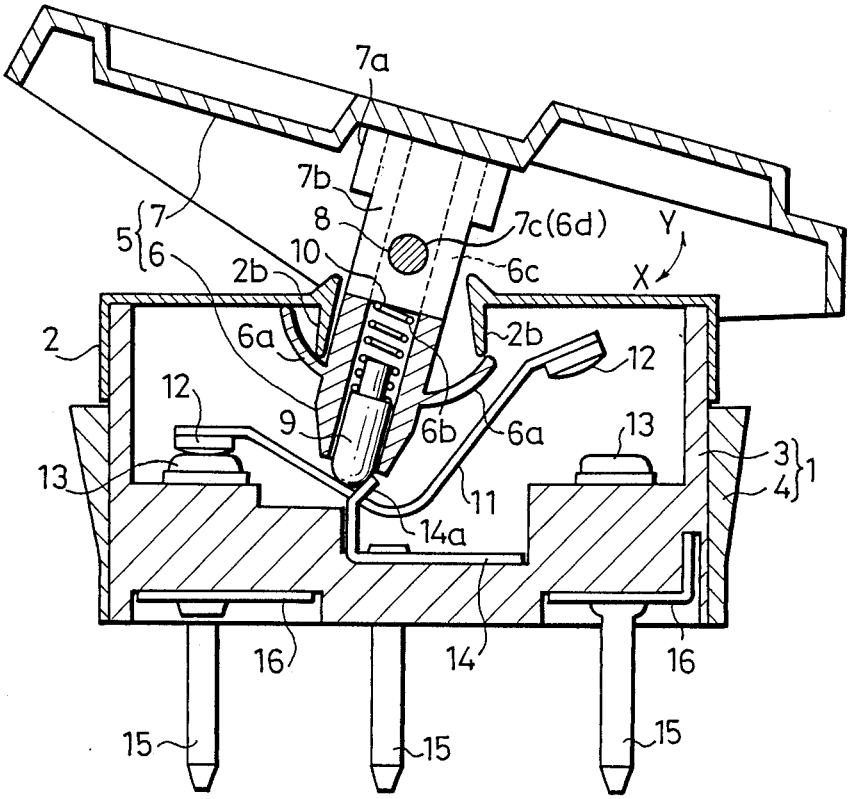
FIG. 1 is a cross sectional view of a switch device showing a preferred embodiment of the present invention.
Figure 2:
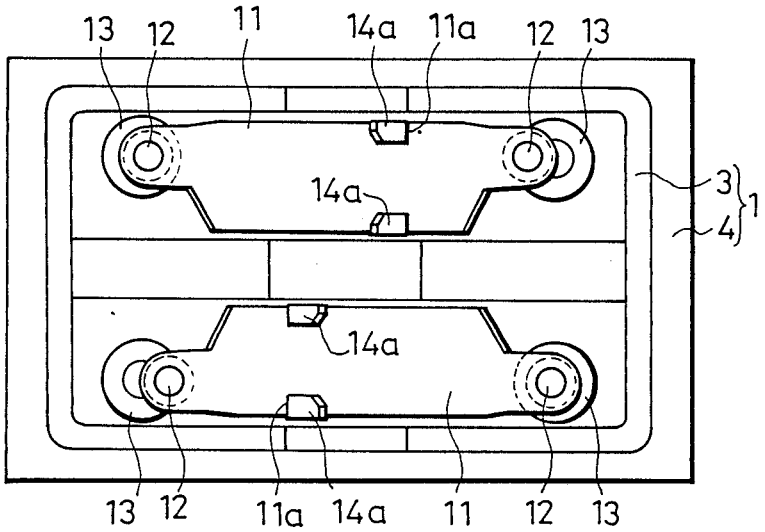
FIG. 2 is a top plan view of the switch device of FIG. 1 with a switch operating member omitted.
Figure 3:
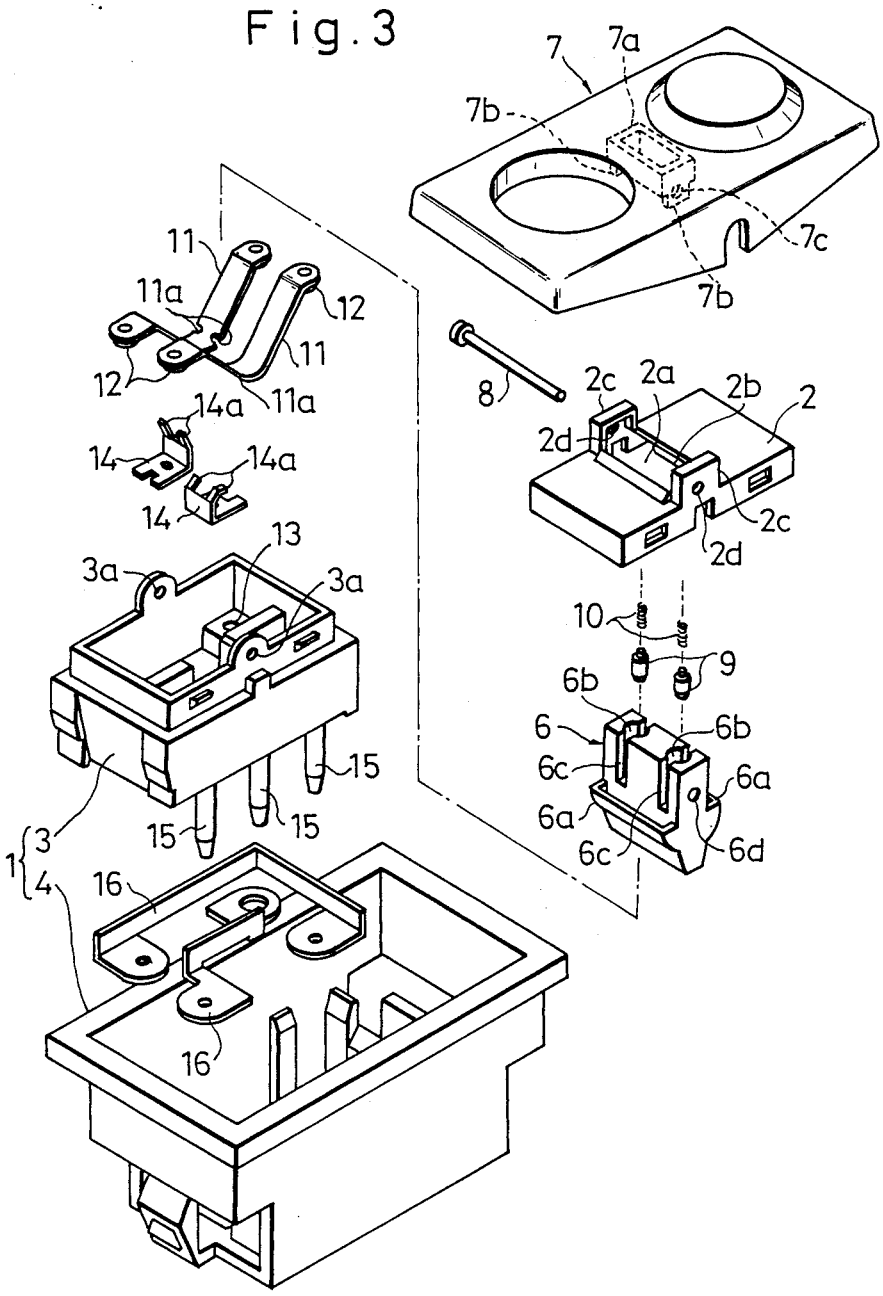
FIG. 3 is a fragmentary perspective view of the switch device of FIG. 1.

Referring to FIGS. 1 to 3 which show a switch device embodying the present invention, the switch device shown includes a casing including a lower case 1 made of a synthetic resin material and having an opening at the top thereof, and an upper case 2 snap-coupled to the top end of the lower case 1. The lower case 1 includes an inner case 3 having a pair of pin receiving holes 3*a* formed in top end portions of a pair of side walls thereof, and an outer case 4 coupled in an integral relationship to the inner case 3. Meanwhile, a switch operating member 5 includes an actuator element 6 and an operating element 7 fitted with each other and coupled in an integral relationship to each other by means of a pin 8.

An upper portion of the actuator element 6 extends upwardly through and above a central opening 2*a* formed in the upper case 2, and a pair of depending walls 2*b* are formed at opposing portions of a circumferential edge of the upper case 2 around the opening 2*a* and extend downwardly toward the lower case 1. A pair of upwardly extending tabs 2*c* are formed at the other opposing edges of the opening 2*a* of the upper case 2 and each has a pin receiving hole 2*d* perforated therein. Meanwhile, a pair of semi-cylindrical flanges 6*a* are formed in an integral relationship on opposite sides of a lower portion of the actuator element 6 such that lower ends of the depending walls 2*b* of the upper case 2 are opposed to upper faces of the flanges 6*a* with a little clearance left therebetween. A pair of vertically extending through-holes 6*b* are perforated in the actuator element 6, and a vertically extending slit 6*c* formed at each of portions of the actuator element 6 corresponding to upper portions of the through-holes 6*b*. A pin receiving hole 6*d* is perforated in the actuator element 6 and extends perpendicularly across the through-holes 6*b*. An actuator bar 9 and a compression coil spring 10 are received in each of the through-holes 6*b* such that a lower end of each of the actuator bars 9 is held in resilient contact with an upper face of a corresponding one of pair of conductor plates 11 which will be hereinafter described.

A frame section 7*a* of a square shape is provided at the center of a lower face of the operating element 7. A pair of opposing walls of the frame section 7*a* on the shorter side are extended downwardly to form a pair of pressing projections 7*b*, and a pin receiving hole 7*c* is perforated at the center of each of the pressing projections 7*b*. In assembly, the operating element 7 is assembled to the actuator 6 from above until lower ends of the pressing projections 7*b* of the operating element 7 are abutted against the bottoms of the slits 6*c* of the actuator element 6, and then the pin 8 is inserted from a side into the mutually aligned pin receiving holes 2*d*, 3*a*, 6*d* and 7*c* respectively of the upper case 2, inner case 3, actuator element 6 and operating element 7 to unite the actuator element 6 and operating element 7 in an integral relationship with each other to form the switch operating member 5 as described above. In this instance, the lower ends of the pressing projection 7*b* are butted with the upper ends of the compression coil springs 10 and thus act as receivers for the compression coil springs 10.

Each of the conductor plates 11 is bent in such a manner as to provide a generally V-shaped side elevation as seen in FIG. 1 and has a pair of recesses or notches 11*a* formed on opposite sides at a longitudinal intermediate portion of one of two arms of the V-shaped of thereof as clearly seen in FIG. 2. The notches 11*a* provide a fulcrum of rocking motion to the conductor plate 11. Each of the conductor plates 11 has a pair of maovable contacts 12 mounted at longitudinal opposite ends thereof.

Up to four fixed contacts 13 are provided at locations of an inner bottom wall of the inner case 3 corresponding to the movable contacts 12 of the conductor plates 11, and a central terminal 14 is located at the center between the fixed contacts 13 in each pair. Each of the central terminals 14 is formed from a metal plate bent in a substantially L-shape in side elevation and has a pair of arresting projections 14*a* formed at opposite sides of an upper end thereof. The arresting projections 14*a* are bent so as to provide an inclined substantially L-shape in side elevation as clearly seen in FIGS. 1 and 3. The arresting projection 14*a* of each of the central terminals 14 extend through the notches 11*a* of the corresponding conductor plate 11 is such a manner as to hold the conductor plate 11 therebetween. Thus, each of the conductor plates 11 is supported for rocking protion around a fulcrum provided by the corresponding central terminal 14.

Further, up to six terminals 15 are mounted on and extend downwardly through and from the bottom wall of the inner case 3 and are held in electric connection to corresponding ones of the fixed contacts 13 and the central terminal 14. A pair of lead plates 16 are secured by caulking to those four terminals 15 which are electrically connected to the fixed contacts 13 such taht each two fixed contacts 13 shown in FIG. 2 located at diagonal positions are held in normal electric connection by way of one of the lead plates 16 on a lower face of the bottom wall of the inner case 3.

With the switch device having such construction as described above, when no pressing force acts upon the operating element 7, the switch operating member 5 assumes a neutral position in which the two actuator bars 9 resiliently contact with portions of the conductor plates 11 at or near the V-shaped bent bottoms. At the neutral position, a left side one of the movable contacts 12 on one of the conductor plates 11 which is shown at an upper location in FIG. 2 is held in contact with the opposing fixed contact 13 while a right side one of the movable contacts 12 on the other conductor plate 11 shown at a lower location in FIG. 2 is held in contact with the opposing fixed contact 13. In other words, the movable contacts 12 remote from the the fulcrums of the conductor plates 11 are held in contact with the respective opposing contacts 13 while the other movable contacts 12 are spaced away from the respective opposing contacts 13.

If the operating element 7 is pushed in the direction of the arrow mark X as shown in FIG. 1 from the neutral position, the switch operating member 5 is pivoted in the same direction of the arrow mark X around the fulcrum provided by the pin 8 whereupon the actuator bars 9 are slidably moved on the inclined upper faces of the conductor plates 11. In this instance, the conductor plate 11 shown at the upper location in FIG. 2 is not rocked and maintains its position wherein the leftwardly located movable contact 12 is held in contact with the opposing fixed contact 13 while only the other conductor plate 11 at the lower location is rocked in the counterclockwise direction in FIG. 1 around the fulcrum provided by the arresting projection 14*a* of the corresponding central terminal 14 to bring the leftwardly located movable contact 12 into contact with the opposing fixed contact 13, thereby causing switching of the switch device.

Similarly, if the operating element 7 is pushed in the direction of the arrow mark Y in FIG. 1 from the neutral position, now the conductor plate 11 at the lower location in FIG. 2 is not rocked with the rightwardly located movable contact 12 thereon held in contact with the opposing fixed contact 13 while only the other conductor plate 11 at the upper location is rocked in the clockwise direction in FIG. 1 around the fulcrum provided by the arresting projections 14*a* of the corresponding central terminal 14 to bring the rightwardly located movable contact 12 into contact with the opposing fixed contact 13, thereby causing switching of the switch device.

Now, an assembling process of the switch device of the embodiment will be described.

At first, the inner case 3 in which the fixed contacts 13, terminals 14 and 15 and lead plates 16 are already incorporated is inserted into the outer case 4 to couple and unite them in an integral relationship with each other. After then, the conductor plates 11 are inserted into the lower case 1 through the upper opening of the lower case 1 until the notches 1*a* thereof are engaged with the arresting projections 14*a* of the central terminals 14 as shown in FIG. 2. Subsequently, the actuator element 6 is placed onto the conductor plates 11, and then the upper case 2 is snapped in to an upper portion of the lower case 1 until an upper portion of the actuator element 6 is projected upwardly through and above the opening 2*a* of the upper case 2. Before or after then, the actuator bars 9 and the compression coil springs 10 are inserted one after another into the through-holes 6*b* of the actuator element 6 from above,, and after then, the operating element 7 is fitted onto the actuator element 6 such that the pressing projections 7*b* thereof may be inserted into the through-holes 6*b* and the slits 6*c* of the actuator element 6. Finally, the pin 8 is inserted into the mutually aligned pin receiving holes 2*d*, 3*a*, 6*d* and 7*c* of the upper case 2, inner case 3, actuator element 6 and operating element 7 in order to unite the actuator element 6 in an integral relationship with the operating element 7 and support the thus united switch operating member 5 for pivotal motion on the casing including the lower case 1 and the upper case 2. In this instance, since the pressing projections 7*b* are inserted to intermediate positions of the through-holes 6*b*, the coil springs 10 are compressed by the lower ends of the pressing projections 7*b*, and consequently the actuator bars 9 are urged to resiliently contact with the upper faces of the conductor plates 11 by the compression coil springs 10.

With the embodiment described above, the components including the conductor plates 11, actuator element 6, actuator bars 9, compression coil springs 10 and operating elements 7 can all be assembled from above the lower case 1. Accordingly, automation of an assembling operation which has been considered difficult so far is enabled, and even in the case of assembly by hand, such an assembling operation can be effected readily because there is little or no possibility of dropping off of the actuator bars 9 or the compression coil springs 10.

Besides, since the inwardly extending depending walls 2*b* are provided at the opposing circumferential edges of the opening 2*a* of the upper case 2 such that the lower ends thereof are opposed to the upper faces of the flanges 6*b* formed on the actuator element 6, foreign acticles such as dust are prevented from entering the inside of the casing by the depending walls 2*b* and the flanges 6*b*. Accordingly, a switch device having a high dust proof property can be attained.

Figure 4:
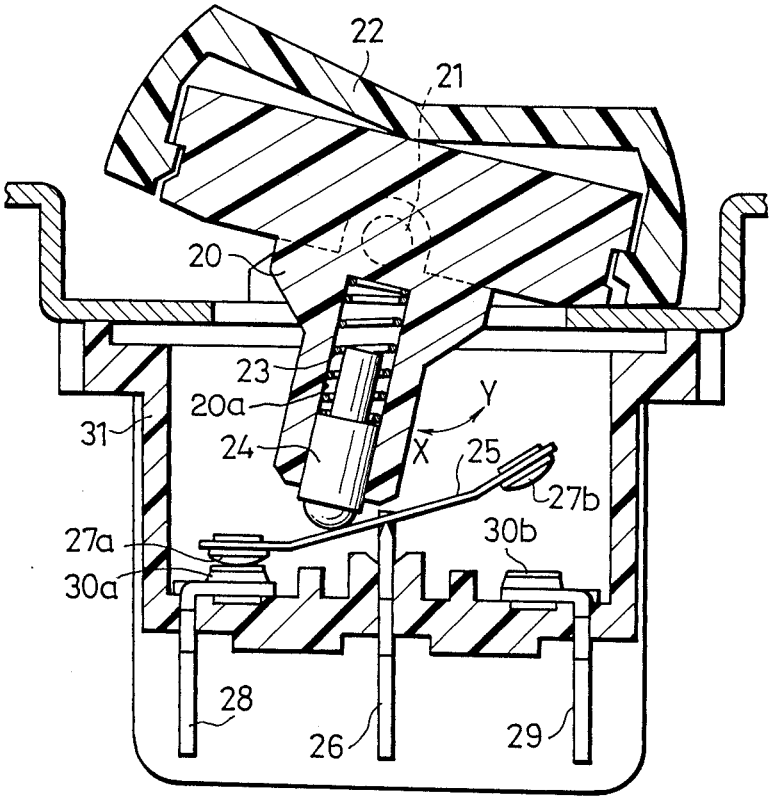
Fig. 4 PRIOR ART
FIG. 4 is a cross sectional view of an exemplary conventional switch device.

It is to be noted that while the embodiment described above is of the interlocking type wherein the pair of conductor plates are alternately rocked by a tilting motion of the switch operating member, it is a matter of course that the present invention can be applied to a switch device of the single-acting type wherein a single conductor plate is rocked by a tilting motion of a switch member to cause switching of the switch device as in the conventional switch device described hereinafter with reference to FIG. 4.

Having now fully described the invention, it will be apparent to one of ordinary skill in the art that many changes and modifications can be made thereto without departing from the spirit and scope of the invention as set forth herein.

What is claimed is:

1. A switch device, comprising:

a casing having defined therein two mutually aligned holes;

an electrical contact assembly including a fixed contact;

a conductor plate pivotally mounted within said casing;

a switch operating member including
an actuator element and
an operating element, the switch operating member being mounted to the casing so as to pivot about a pivot axis extending between the mutually aligned holes, said actuator element having a through-hole having a top and a bottom end formed therein extending in a direction perpendicular to the pivot axis, said bottom end of said through-hole is adjacent to and faces said conductor plate mounted in said casing there being a predetermined clearance between the bottom end of the through-hole and said conductor plate;

an actuator bar having a first end and a second end recieved in said through-hole of said actuator element for sliding therein, said first end of the said bar extending partially out the bottom end of said through-hole, and being of such a length as to span said predetermined clearance while said second end of said bar is slidably disposed in said through-hole; and a spring having a first end and a second end received in said through-hole of said actuator element, wherein said first end is operatively coupled with said second end of said bar;

wherein said operating element has a pressing projection which is formed thereon to complimentarily match said top of said through-hole in said actuator element, said pressing projection has an end which is operatively coupled to said second end of said spring in said through-hole to press against said second end of said actuator bar to urge said first end of said actuator bar to contact said condutor plate.

2. A switch device according to claim 1, wherein an upper portion of said actuator element of said switch operating member has a slit formed therein such that said slit coincides and crosses through said top end of said through-hole, and said pressing projection is formed on a lower face of said operating element such that it is received in said slit.

3. A switch device according to claim 1 wherein said actuator element has a pair of flanges which form a semicylindrical shape on opposite sides of the actuator element about the pivotal axis of said switch operating member, said casing having an opening formed therein through which said switch operating member extends outwardly of said casing, said casing has a pair of depending walls formed at opposite edges of said opening parallel to said pivotal axis, and said depending walls of said casing having lower ends located in an opposing relationship to upper faces of said flanges of said actuator element with a clearance left therebetween.

4. A switch device according to claim 1 wherein said conductor plate has a substantially V-shaped inside elevation and has a movable contact mounted at a longitudinal end for contacting said fixed contact secured to said casing, said conductor plate being supported for pivotal motion at a portion thereof adjacent to the center thereof thereby allowing the conductor plate to rock around an axis perpendicular to the longitudinal axis of said conductor plate so that said movable contact contacts said fixed contact when said switch operating member assumes a neutral position.

5. A switch device according to claim 4, wherein said conductor plate is supported for pivotal motion at an upper end of a terminal secured to said housing.

6. A switch device according to claim 5, wherein said conductor plate has a pair of notches formed on opposite longitudinal edges, and said terminal has a pair of arresting projections formed at the upper end thereof and fitted in said notches of said conductor plate to support said conductor plate for pivtal motion at the upper end of said terminal.

7. A switch device comprising:

an insulating casing, having a bottom wall and said walls, with a pair of mutually aligned pin receiving holes in opposite sides of the top portion of said side walls, having at least one terminal located inside said casing on said bottom wall, at least one fixed contact located inside of said casing on said bottom wall adjacent to said terminal, at least two terminals, a first at least one outside terminal and a second at least one outside terminal located outside of said casing;

means for connecting the at least one terminal located adjacent to the contact located inside the casing on the bottom wall with the second at least one outside terminal located outside of said casing;

means for connecting the at least one fixed contact located on the inside of the bottom wall with the first at least one outside terminal;

a rockable conductor plate having a movable contact on one end thereof wherein the conductor plate is supported and pivots on the at least one terminal located inside the casing on the bottom wall such that pivoting of the plate in a first direction causes the movable contact to contact the fixed contact and pivoting of the plate in a second direction causes the movable contact to separate from the fixed contact;

a switch operating member including an actuator element and an operating element, the actuator element being made of a solid block material having a through-hole;

a pin for mounting said switch operating member for pivotal motion, said actuator element having a through-hole formed therein, said actuator element further having a pin receiving hole formed therein in a direction perpendicular to said through-hole, said operating element having a depending pressing projection formed thereon which has a pin receiving hole formed therein and is inserted in said through-hole of said actuator element, said pin extending through the mutually aligned pin receiving holes of said casing, said actuator element, and said operating element to unite said casing, said actuator element, and said operating element with each other; an actuator bar received in said through-hole of said actuator element for sliding movements; and a spring received in said through-hole of said actuator element between an end of said pressing projection of said operating element and an end of said actuator bar for urging said actuator bar to contact with said conductor plate, whereby a tilting motion of said switch operating member around said pin to slidable move said actuator bar on said conductor plate will cause rocking motion of said conductor plate to make a switching operation of said switch device.

8. An electrical switch comprising:

a casing;

an electrical contant assembly mounted in said casing comprised of a movable conductor plate having a movable contact at one end, and a fixed contact disposed in said casing;

an operating member movably disposed within the casing, the operating member having a through-hole defined therethrough;

an actuator member reciprocally disposed within the through-hole having a first end which contacts said conductor plate;

a spring, having first and second ends, disposed within the through-hole of the operating member; and a spring pressing member inserted into the through-hole to press against the second end of the spring such that the first end of the spring urges said actuator member to contact said conductor plate, wherein movement of said operating member in a first direction causes said movable contact to contact said fixed contact and movement of said operating member in a second direction causes said movable contact to separate from said fixed contact.

9. A switch device according to claim 1 wherein said conductor plate has a substantially V-shaped inside elevation and has a movable contact mounted at a longitudinal end for contacting said fixed contact secured to said casing, said conductor plate being supported for pivotal motion at a portion thereof adjacent to the center thereof thereby allowing the conductor plate to rock around an axis perpendicular to the longitudinal axis of said conductor plate so that said movable contact does not contact said fixed contact when said switch operating member assumes a neutral position.

10. A switch device according to claim 9, wherein said conductor plate is supported for pivotal motion at an upper end of a terminal secured to said housing.

* * * * *